US005160143A

United States Patent [19]

Dwyer

[11] Patent Number: 5,160,143

[45] Date of Patent: Nov. 3, 1992

[54] GOLF STROKE TRAINING AID

[76] Inventor: Brett Dwyer, 7 Tewksbury Rd., Worcester, Mass. 01602

[21] Appl. No.: 839,927

[22] Filed: Feb. 21, 1992

[51] Int. Cl.[5] ..... A63B 69/36

[52] U.S. Cl. ..... 273/186.2; 273/194 A

[58] Field of Search ..... 273/186 A, 186 R, 186 B, 273/186 C, 186 D, 186 E, 194 R, 194 A, 194 B, 183 D, 163 R, 163 A, 164

[56] References Cited

U.S. PATENT DOCUMENTS

| | | | |
|---|---|---|---|
| 3,021,141 | 2/1962 | Polsky et al. | 273/186 A |
| 3,384,376 | 5/1968 | Greenlee | 273/164 |
| 3,489,415 | 1/1970 | Smith | 273/186 A |
| 3,667,761 | 6/1972 | Palotsee | 273/194 A X |
| 3,810,633 | 5/1974 | Scott | 273/194 A X |
| 4,002,343 | 1/1977 | Eckert | 273/163 R |
| 4,323,246 | 4/1982 | Nehrbas | 273/186 A |
| 4,953,867 | 9/1990 | Rigsby | 273/183 D |
| 5,092,603 | 3/1992 | Schindler | 273/186 A |

*Primary Examiner*—George J. Marlo

[57] ABSTRACT

A golf stroke training device for use with the head of a conventional golf club. The golf stroke training device includes a body of relatively soft compressible material which has a pair of opposed vertical legs which are removably fastened to the ball striking surface of a golf club so that the center of percussion of the striking surface is midway between the legs. The body has a head portion which connects the two legs and which has a central aperture for receiving an elongated rod which extends transversely of the striking face of the club.

12 Claims, 2 Drawing Sheets

GOLF STROKE TRAINING AID

BACKGROUND OF THE INVENTION

1. Field of the Invention

The subject invention generally pertains to golf training devices and, more specifically, to a golf stroke training device which promotes proper alignment and on-center striking of the golf ball on the club face.

2. Description of Related Art

Many current golf stroke alignment and stroke path devices are complicated, difficult to attach and inconvenient to use. They alter the fundamental playing characteristics of the putter by changing its visual appearance, kinesthetic feel, weight and balance.

Other known related art includes golf clubs with heads which are modified or specifically designed for the attachment of alignment and striking guides, thereby limiting the golfer to practicing with that particular style club which may not be effectively compatible with the golfer's size, stance, posture and stroke tendencies. These and other difficulties experienced with the prior art golf training devices have been obviated by the present invention.

It is, therefore, a principal object of the present invention to provide a golf stroke training device which utilizes the golfer's senses of sight, feel and hearing to help the golfer learn to contact the ball with the percussion center of the club face during the stroke.

Another object of the invention is to provide a golf stroke training device which helps the golfer to properly aim the club face along the intended line of the putt and to monitor the club face position during the stroke.

Another object of the invention is to provide an alignment centered striking device which is extremely light weight and does not alter the fundamental playing characteristics of the golf club.

Another object of the invention is to enable the golfer to ascertain on what area of the club face his missed hits are occurring, judging by the direction in which the golf ball has veered.

Still another object of the invention is to provide an alignment centered striking device which can be attached to the club faces of several different styles of golf clubs.

A further object of the invention is to provide an alignment centered striking device which may be used for both practicing and while playing on the course.

A further object of the invention is to provide an alignment centered striking device which promotes on center hits and proper alignment of the club face at the same time.

With these and other objects in view, as will be apparent to those skilled in the art, the invention resides in the combination of parts set forth in the specification and covered by the claims appended hereto.

SUMMARY OF THE INVENTION

In general, the invention consists of a golf stroke training device for use with the head of a conventional golf club, including but not limited to a putter. The golf stroke training device includes a body of relatively soft compressible material which has a pair of opposed spaced vertical legs which are removably fastened to the striking surface of the club so that the center of percussion of the striking surface is intermediate of the legs. More specifically, the body has a head portion which connects the two legs and which has a central aperture for receiving an elongated rod which extends transversely of the striking face of the club. The body of the golf stroke training device is preferably attached to the striking surface of the club face by means of pressure sensitive adhesive on the back surface of the body.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
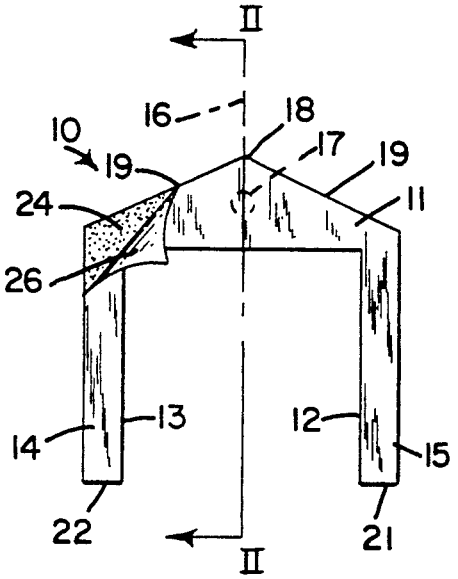
FIG. 1 is a rear elevational view of the main body portion of the golf stroke training device of the present invention.
Figure 2:
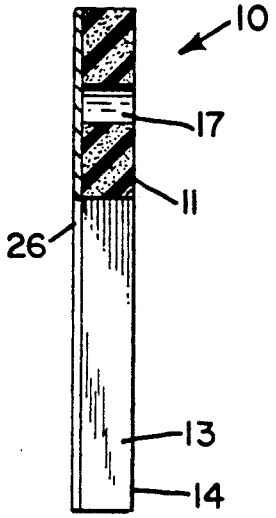
FIG. 2 is a vertical cross-sectional view on an enlarged scale taken along the line II—II of FIG. 1 and looking in the direction of the arrows.
Figure 3:
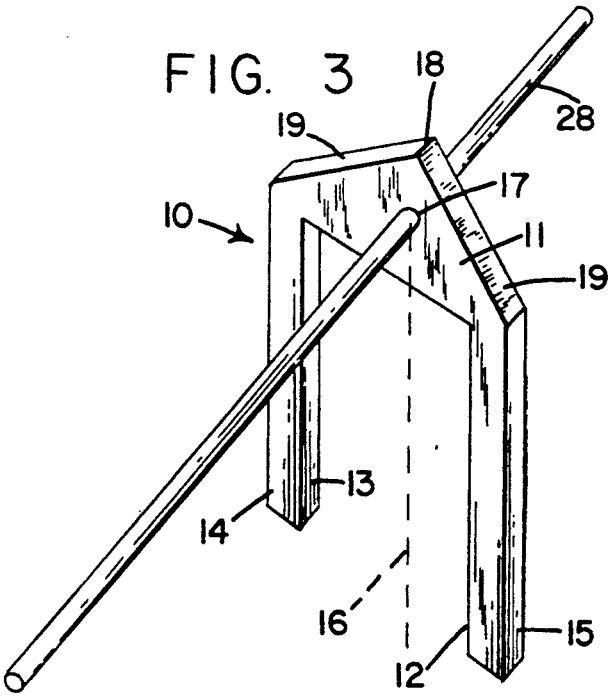
FIG. 3 is a perspective view of the golf stroke training device of the present invention.

Referring to the drawings, the golf stroke training device of the present invention comprises a body 10 of relatively soft compressible material such as foam rubber, or soft light-weight compressible polyethylene foam. The preferred material is a high density cross linked polyethylene foam. The body 10 comprises a pair of spaced vertical legs 14 and 15 which are connected by a top bar 11. The legs 14 and 15 have opposed inwardly facing side edges 13 and 12, respectively. The bar 11 has a top edge 19 which slopes upwardly from each leg to an apex 18 which is vertically aligned with a vertical line 16 that bisects the legs 14 and 15. The top bar 11 also has an aperture 17 which extends transversely of the plane of the body 10 just below the apex 18. An elongated rod, generally indicated by the reference numeral 28, is removably inserted through the aperture 17 as shown in FIG. 3 so that it extends along a longitudinal axis which is transverse to the plane of the body 10. The rod 28 comprises an outer cylindrical tube 32 and an inner cylinder 34 which is telescopically mounted within the tube 32 for movement along the central longitudinal axis of the tube 32. The tube 32 has a dark color which contrasts with the white of the golf ball over which the tube 32 extends. The inner cylinder 34 has a light color i.e., yellow, which contrasts with the dark color of the tube 32. The inner cylinder 34 can be extended forwardly from the forward end of the outer tube 32 to increase the effective length of the rod 28 to the extent desired. The contrasting colors of the outer tube 32 and the inner cylinder 34 highlights the forward end of the rod 28 for alignment purposes. The rear surface of the body 10, indicated by the reference numeral 24, is covered by a pressure sensitive adhesive. The surface 24 is protected by a sheet of release paper 26 which has very smooth and slippery surfaces. The paper 26 protects the adhesive against contaminants and can be easily peeled away as shown in FIG. 1 to expose the surface 24 when it is desired to apply the body 10 to the ball striking surface of a golf club head.

Figure 4:
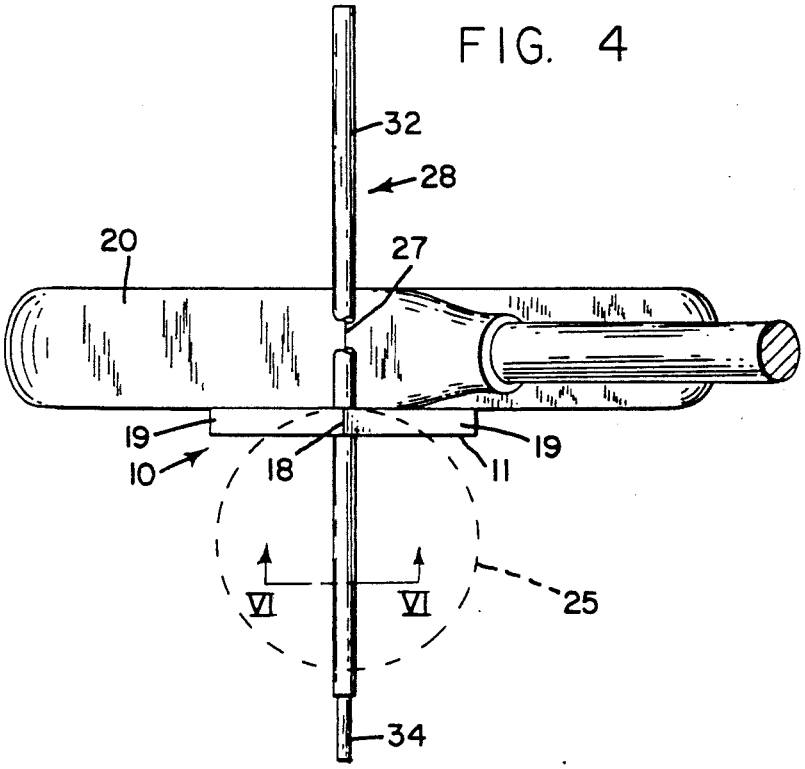
FIG. 4 is a top plan view of the golf stroke training device shown attached to the ball striking face of a putter.
Figure 6:
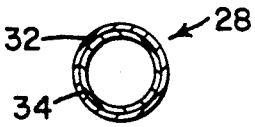
FIG. 6 is a vertical cross-sectional view of on enlarged scale taken along the line VI—VI of FIG. 4 and looking in the direction of the arrows.
Figure 5:
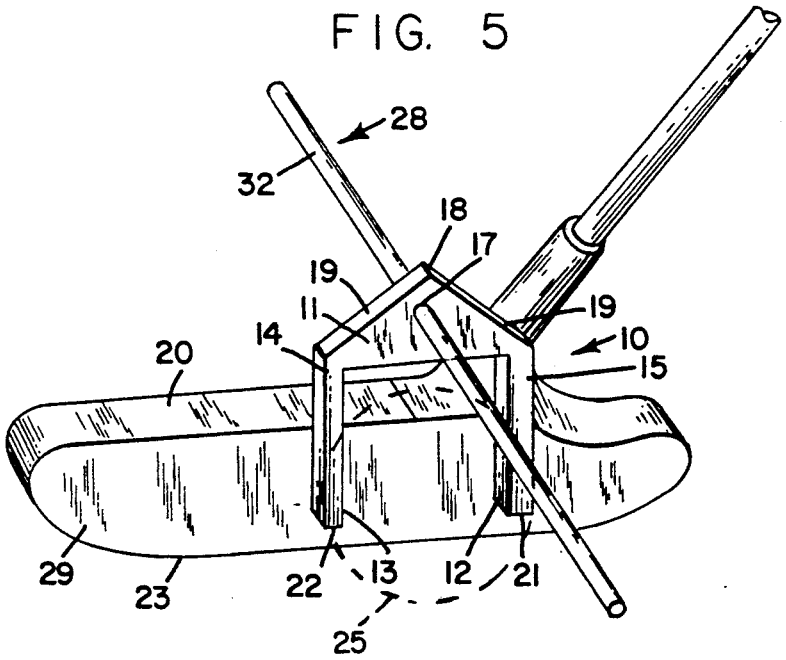
FIG. 5 is a perspective view of the golf stroke training device of the present invention shown applied to the ball striking face of a putter.

Referring particularly to FIGS. 4 and 5, the golf stroke training device of the present invention is utilized by removing the release paper 26 from the surface 24 of the body 10 and inserting the elongated rod 28 through the aperture 17 so that the rod 28 extends forward and rearwardly of the body 10 as shown in FIGS. 4 and 5. The body 10 is applied to the ball striking surface 29 of a golf club head 20 by pressing the surface 24 against the surface 29 with sufficient pressure to enable the body 10 to stick to the surface 29. The body 10 is positioned on the club head 20 so that when the club is held in the normal ball striking position, the legs 14 and 15 extend vertically and the center of percussion of the ball striking head 29 is midway between the legs 14 and 15. In the example shown in the drawings, the golf club is a putter. The heads of most putters have an indicator along the top edge of the putter which is theoretically vertically aligned with the center of percussion of the ball striking face. The putter head 20 is provided with such an indicator which is identified by the reference numeral 27. Assuming that the indicator line 27 is aligned with the center of percussion of the ball striking face 29, the body 10 is positioned so that the apex 18 which is midway between the legs 14 and 15 is aligned with the indicator line 27 as shown in FIG. 4. This automatically positions the legs 14 and 15 so that the legs are equally spaced from the center of percussion. When a golf ball, indicated by the dotted line 25, is struck by the golf club with the body 10 attached thereto, the ball is struck by the ball striking face 29 if the ball is struck at the center of percussion. The legs 14 and 15 limit the area of contact between the ball and the club face 29. Only balls which are struck at the center of percussion or "sweet spot" of the club face will roll properly along an intended line. Balls which are hit away from the center of percussion will strike one of the legs. This will cause the ball to lose velocity and veer significantly off line. In addition, when the ball is struck by one of the legs, it will not feel solid and it will not make the same sound as a ball which is struck by the center of percussion or "sweet spot" area of the club face. The golf stroke training device of the present invention utilizes the golfer's visual, kinesthetic and auditory senses for learning. The use of several senses intensifies the training effect of the training device. In addition, the body 10 is light weight so that the dynamics of the golf stroke are negligibly affected. The elongated rod 28 extends horizontally and transversely of the ball striking face 29 and extends rearwardly and forwardly of the face 29. The elongated rod 28 lies directly over the center of percussion or "sweet spot" of the club face 29 and helps the golfer to align the club head so that the ball is struck at the "sweet spot" of the club face. The elongated rod also helps the golfer to properly align the club face with the target and helps the golfer to swing the club head along a line which extends directly to the target. The elongated rod also allows the golfer to monitor the angle of the club face during the entire stroke.

The back surface 24 of the body 10 can also be provided with a layer of magnetic material for use with golf club heads which are made of a paramagnetic material.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A golf stroke training device for use with the head of a conventional golf club, said head having a front ball striking surface which has a center of percussion, said device comprising:

(a) a body of relatively soft compressible material which includes a pair of opposed spaced vertical legs, said body having a head portion which extends from the top of one of said legs to the top of the other of said legs, said head portion having a horizontal aperture which extends along a horizontal axis which is transverse to the front surface of the club head and above said club head when said device is applied to said front surface, (b) fastening means for releasably fixing said body to the ball striking surface of the putter so that the center of percussion of said surface is intermediate of said legs, and (c) an elongated rod which extends through said aperture so that said rod extends horizontally and transversely to the front surface of said club head and is located above said center of percussion when said device is attached to said front surface.

2. A golf stroke training device as recited in claim 1, wherein said body has a flat rearward vertical surface and said fastening comprises pressure sensitive adhesive on said rearward vertical surface which enables said body to be fastened to said ball striking surface by pressing said body against said ball striking surface and which enables said body to be removed from said ball striking surface by pulling said body away from said ball striking surface.

3. A golf stroke training device as recited in claim 2, further comprising a sheet of planer material having a smooth release surface which is removably applied to said rearward surface when said body is not applied to a golf club for protecting the pressure sensitive adhesive.

4. A golf stroke training device as recited in claim 1, wherein said head portion has a top edge and a visual indicator at said top edge which is vertically aligned with the horizontal axis of said aperture.

5. A golf stroke training device as recited in claim 4, wherein said top edge extends at an upward angle from each of said legs toward an apex which is sideways between said legs, said apex serving as said visual indicator.

6. A golf stroke traning device as recited in claim 1, wherein said elongated rod comprises:

(a) an outer cylindrical tube which has a central longitudinal axis, and (b) an inner cylinder which is mounted within said outer tube for telescoping motion along the central longitudinal axis of said outer tube for increasing the effective length of said rod.

7. A golf stroke training device as recited in claim 1, wherein said body is made of foam rubber.

8. A golf stroke training device as recited in claim 1, wherein said body is made of high density cross linked polyethylene foam.

9. A golf stroke training aid for use with the head of a conventional golf club, said head having a front ball striking surface which has a center of percussion, said device comprising, (a) a body which has a head portion having an aperture and a pair of vertical spaced leg portions which extend downwardly from said head portion, (b) means for removably attaching said body to said front ball striking surface so that said center of percussion is equidistant between said leg portions and at least a portion of said head portion is higher than the head of said club, and (c) an elongated rod which is removably mounted in said aperture in said head portion so that said rod is above the head of said club and extends transversely of said ball striking surface when said aid is attached to said surface.

10. A golf stroke training aid as recited in claim 9, wherein said rod has a central longitudinal axis and is mounted in said head portion for sliding motion along said axis.

11. A golf stroke training aid as recited in claim 9, wherein said rod comprises:

(a) an outer cylindrical tube which has a central longitudinal axis, and (b) an inner cylinder which is mounted within said outer tube for telescoping motion along the central longitudinal axis of said outer tube for increasing the effective length of said rod.

12. A golf stroke training aid as recited in claim 11, wherein said outer tube has a first color and said inner cylinder has a second color which is distinct from said first color.

* * * * *